US009687124B1

(12) United States Patent
Riggs, Jr.

(10) Patent No.: US 9,687,124 B1
(45) Date of Patent: Jun. 27, 2017

(54) MULTI-PURPOSE BATHROOM VALET

(71) Applicant: David Wray Riggs, Jr., Rio Rancho, NM (US)

(72) Inventor: David Wray Riggs, Jr., Rio Rancho, NM (US)

( * ) Notice: Subject to any disclaimer, the term of this patent is extended or adjusted under 35 U.S.C. 154(b) by 0 days.

(21) Appl. No.: 15/419,884

(22) Filed: Jan. 30, 2017

Related U.S. Application Data

(60) Provisional application No. 62/288,895, filed on Jan. 29, 2016.

(51) Int. Cl.
*A47K 10/22* (2006.01)
*A47K 10/38* (2006.01)
*A47B 81/00* (2006.01)

(52) U.S. Cl.
CPC ..... *A47K 10/22* (2013.01); *A47B 81/00* (2013.01); *A47K 10/38* (2013.01); *A47K 2010/389* (2013.01)

(58) Field of Classification Search
CPC ..... A47K 10/22; A47K 10/32; A47K 10/38; A47K 2010/389; A47K 2010/3253; A47B 81/00; F16M 11/22
USPC ..... 211/85.5
See application file for complete search history.

(56) References Cited

U.S. PATENT DOCUMENTS

| | | | | |
|---|---|---|---|---|
| 4,602,759 | A * | 7/1986 | Webber | A47B 97/00 211/133.1 |
| 4,825,779 | A * | 5/1989 | Simms | A47K 17/02 108/50.17 |
| D315,459 | S * | 3/1991 | Young, III | D34/21 |
| 5,947,307 | A * | 9/1999 | Battaglia | A47F 5/101 108/108 |
| 6,364,137 | B1 * | 4/2002 | Glauth | A47F 5/137 211/126.9 |
| 6,575,316 | B2 | 6/2003 | Lin | |
| 6,935,520 | B1 * | 8/2005 | Lund | B25H 1/12 211/133.5 |
| 6,974,043 | B1 | 12/2005 | Lai | |
| 7,264,196 | B2 | 9/2007 | Guay | |
| 2012/0234963 | A1 | 9/2012 | Channel | |

* cited by examiner

*Primary Examiner* — Ko Hung Chan
*Assistant Examiner* — Korie H Chan

(57) ABSTRACT

A multi-purpose free standing floor rack designed to hold a plurality of items in the bathroom and consists of a vertical upright standing frame, two u-shaped openings as the base for support and are configured for conveniently storing magazines or tablets. A u-shaped opening and a wire mesh basket attached in the middle portion. A wire mesh shelf attached at the bottom and in the middle to store extra rolls of toilet paper or a cell phone. A protruding rod attached between the middle and the top portion that holds the roll of toilet paper in use. A concaved round plate attached on the top for holding a cup of coffee or other beverages.

1 Claim, 7 Drawing Sheets

MULTI-PURPOSE BATHROOM VALET

CROSS REFERENCE TO RELATED APPLICATIONS

This application takes priority from provisional application No. 62/288,895 filed on Jan. 29, 2016. By David W. Riggs Jr. Title: Multi-purpose bathroom valet.

BACKGROUND OF THE INVENTION

1. Field of the Invention

The present invention relates to a free standing toilet paper roll holder but more particularly has the usage of a storage device to hold multiple items. This invention takes care of a lot of different needs since there are a multiple of things that people would love to have handy. My invention solves that by having a couple sized shelves to hold toilet paper on the bottom shelf. A cell phone for example, or women's personal hygiene items on the middle shelf. U-shaped supports on the bottom to hold magazines or a tablet, along with a basket and smaller U-shaped holder towards the middle to hold pens, pencils, and a note pad for example. Above the basket and U-shaped holder is the main toilet paper holder. The other item that is different from all other inventions that are out there, is that the current invention has a round plate on the very top that can serve as a drink holder, or to put a cell phone and or other items one may desire to also put there.

2. Description of the Prior Art

There are several different types of floor rack/toilet paper dispensers and holders out there. The types that are out there are only able to hold a few limited items. For example, U.S. Pat. No. 6,974,043 B1 will hold only two rolls of toilet paper, a toilet brush cleaner and then you have to remove the toilet brush holder (which would most likely be dirty) to attach another type of holder that could hold paper or a magazine.

Another example is U.S. Patent Number 2012/0234963 A1 this example holds many rolls of toilet paper and that is it.

Other devices such as U.S. Pat. No. 6,575,316 B2 are very similar to the first patent I described except this one you do not have to remove the toilet brush holder in order to hold a newspaper or such an item.

Once again, U.S. Pat. No. 7,264,196 B2 is very much like second one I mentioned that only holds toilet paper. However, it claims that it can be wall-mounted so there is some difference in this one vs. others, These examples in the prior art are good ideas but only hold up to around three items. The prior art examples described here are fairly common to a lot of other ones that I have seen out in stores already. They do not solve the needs of other common items that most people would like to have handy, without having multiple other devices or storage items to hole a multiple of things that one might want to have in the bathroom with them. This is where the present invention is very different and comes in handy to solve those needs of holding multiple items of one's choice all in one unit.

SUMMARY OF THE INVENTION

With all of the prior art just mentioned and the short comings of all other toilet paper holders, none have the ability to solve the need of being able to hold a multiple of items, all in one unit, like the present invention.

It is therefore this present invention was created to solve the fundamental needs and improve upon all prior inventions that are out in the market now. As stated, this is a new and improved toilet paper holder that holds many things and can be positioned on the floor where it is convenient for the consumer.

It is further an object of the present invention that will provide the storage of a couple of toilet paper rolls on the bottom shelf.

It is still another object of the present invention to provide on both sides of the unit, to hold a multiple number of magazines on the bottom two u-shaped holders.

Another object of the present invention on the middle shelf is to hold a cell phone, for example, or other items as desired by the individual. Some women, for example, may put personal items on this middle shelf such as their jewelry or other things, It is still another object of the present invention in the middle area on the u-shaped holder to hold a small notepad, for example.

It is still another object of the present invention in the middle area of the u-shaped basket with covered ends to hold pens, pencils, fingernail files, a small pad for sticky notes and a small calculator.

Yet another object of the present invention is the bar that protrudes out towards the top of the unit. This is the bar that holds the main roll of toilet paper for use. This bar also allows for easy installation of the toilet paper rolls versus the conventional type that mount to the wall and/or others that have the spring loaded plastic item that usually holds the toilet paper in place.

A final object of the present invention is the round plate on the very top. This plate is to hold a cup of coffee, for example, or other beverages of one's choice.

These and other objects, features and benefits of the present invention will become apparent to those skilled in this art upon reading the accompanying description, drawings, and claims set forth herein. The headings provided herein are for the convenience of the reader only. No headings should be construed to limiting upon the content in anyway.

BRIEF DESCRIPTION OF THE DRAWINGS

A complete understanding of the present invention can be referenced by the accompanying drawings in conjunction with the subsequent detailed description. The accompanying drawings are as follows.

DETAILED DESCRIPTION OF THE INVENTION

Figure 1:
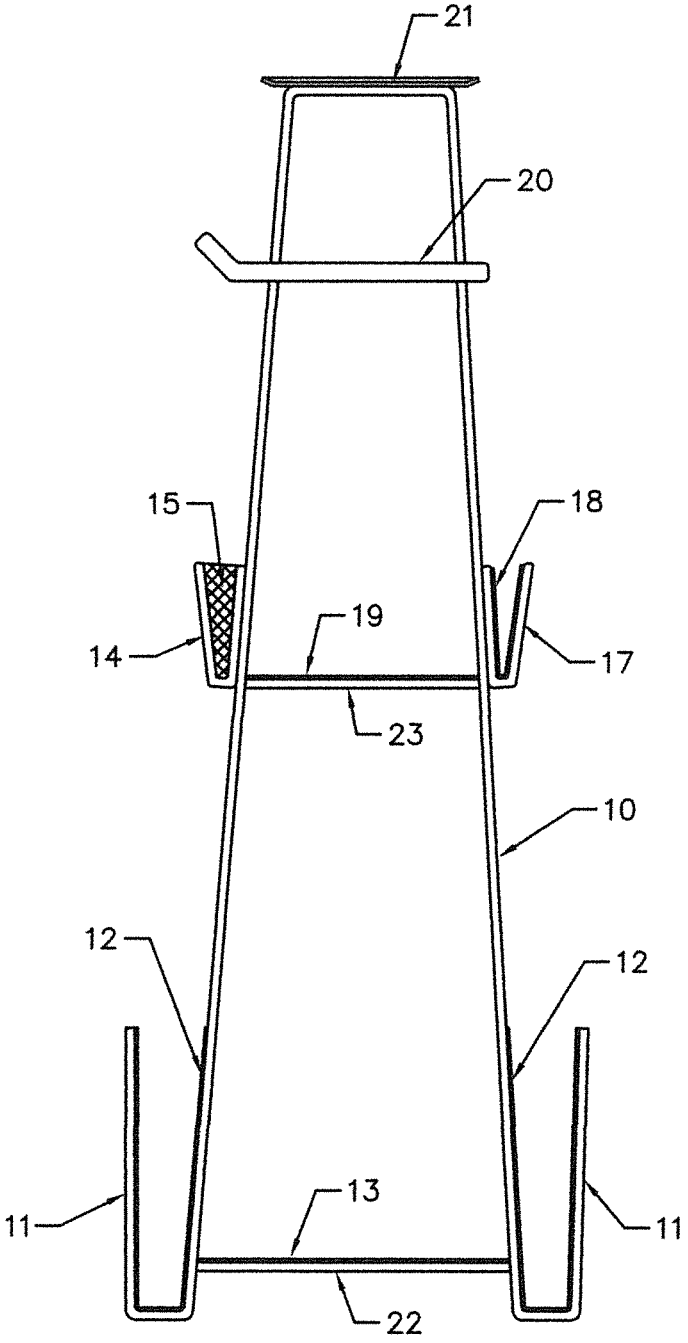
FIG. 1 is a front view of the Multi-Purpose Bathroom Valet

Reference is made herein to the attached drawings. Like reference numerals are used throughout the drawings to depict like or similar elements of the multi-purpose bathroom valet. For the purposes of presenting a brief and clear description of the present invention, the preferred embodiment will be discussed as used. The figures are intended for representative purposes only and should not be considered to be limiting in any respect.

Figure 7:
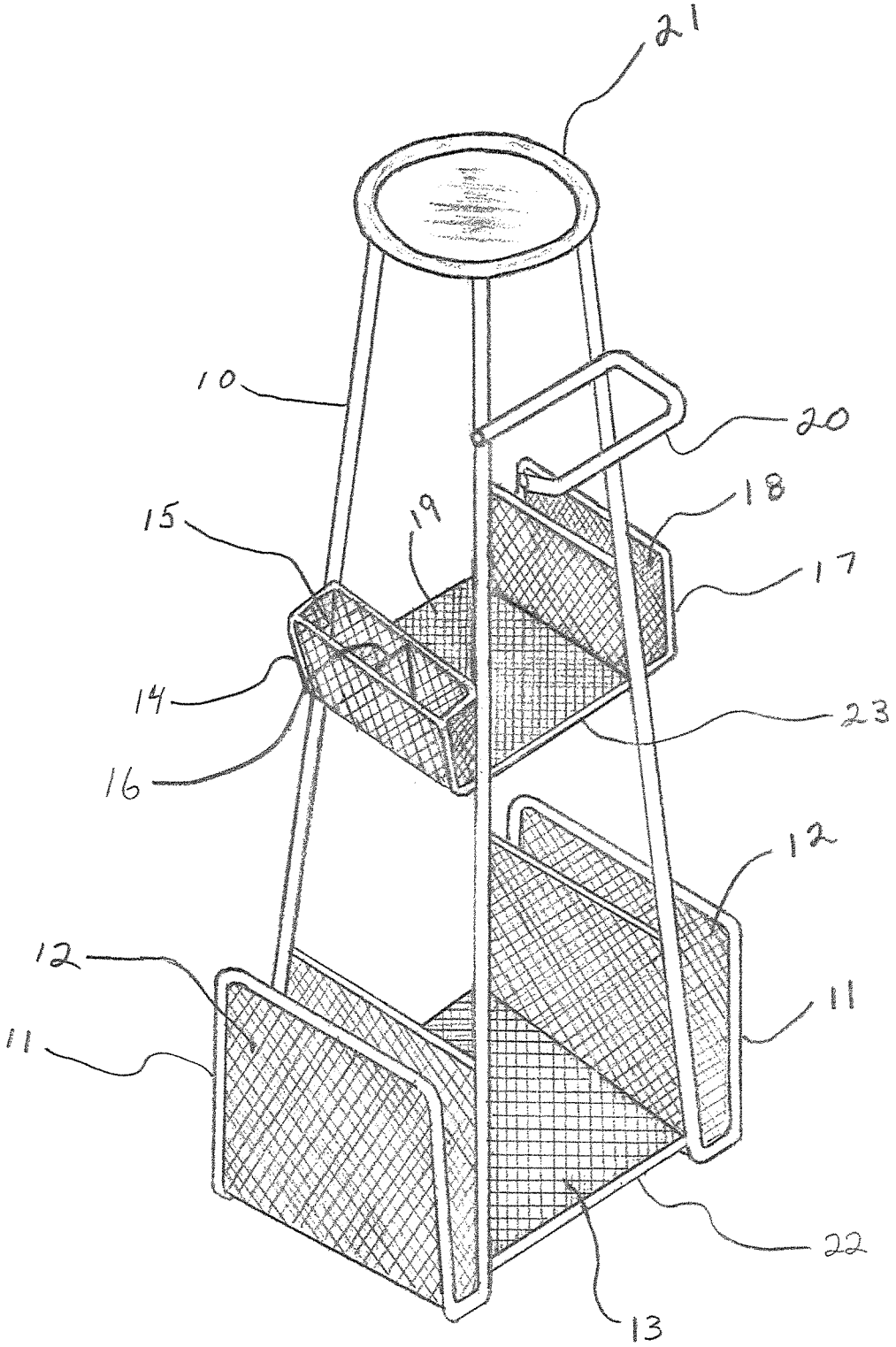
FIG. 7 is a pictorial view of the Multi-Purpose Bathroom Valet

Referring now to FIGS. 1 and 7, there is shown a perspective view of the best mode contemplated of the multi-purpose bathroom valet according to the concepts of the present invention.

Figure 3:
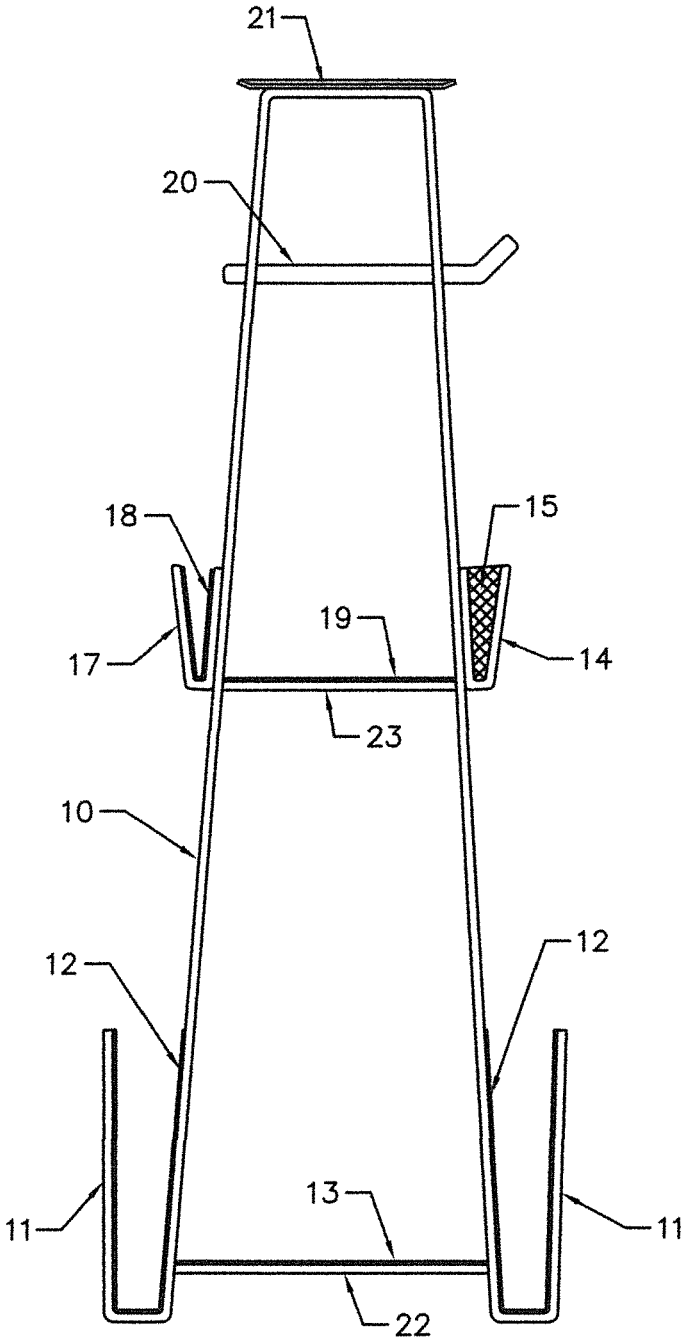
FIG. 3 Is a back view of the Multi-Purpose Bathroom Valet

Referring now to FIGS. 1 and 3, comprising of a vertical upright standing frame 10, with two u-shaped openings 11 at the base, which are used to support the entire unit. The two u-shaped openings 11, are lined with wire mesh 12. Between the two u-shaped openings 11, is a wire mesh shelf 13, attached to a metal support frame 22, that is intended to store extra rolls of toilet paper. The metal support frame 22, is attached to the bottom of the vertical upright standing frame 10.

Referring now to FIGS. 1 and 3, another u-shaped basket 14, that is lined with wire mesh 15, on all five sides. Referring now to FIG. 7 there is shown a pictorial view of a divider 16, inside the u-shaped basket 14, intended to help separate small items, such as, pens, pencils, and fingernail files on one side and on the other side sticky note pads, a small calculator or whatever one desires to store on either side. The u-shaped basket 14, is attached in the middle of the vertical upright standing frame 10, between the basket 14, and the u-shaped opening 17.

Referring now to FIGS. 1 and 3, another u-shaped opening 17, that is lined with wire mesh 18, intended to hold a small note pad. Between the basket 14, and u-shaped opening 17, there is a second wire mesh shelf 19, attached to a metal support frame 23, is intended to have various articles like a cell phone, for example, or other personal items one may desire. The metal support frame 23, is attached to the middle of the vertical upright standing frame 10.

Referring now to FIGS. 1 and 3, the main toilet paper holder 20, is attached near the top of the vertical upright standing frame 10.

Referring now to FIGS. 1 and 3, the beverage holder 21, is attached at the top of the vertical upright standing frame 10.

Figure 2:
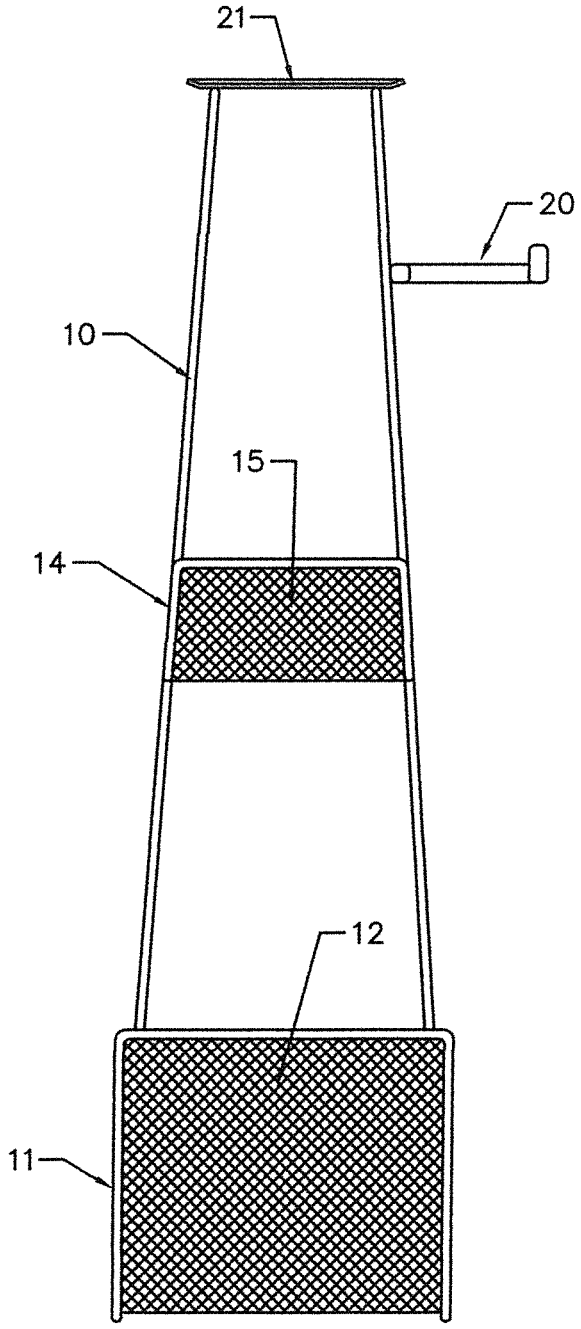
FIG. 2 Is a side view of the Multi-purpose Bathroom Valet
Figure 4:
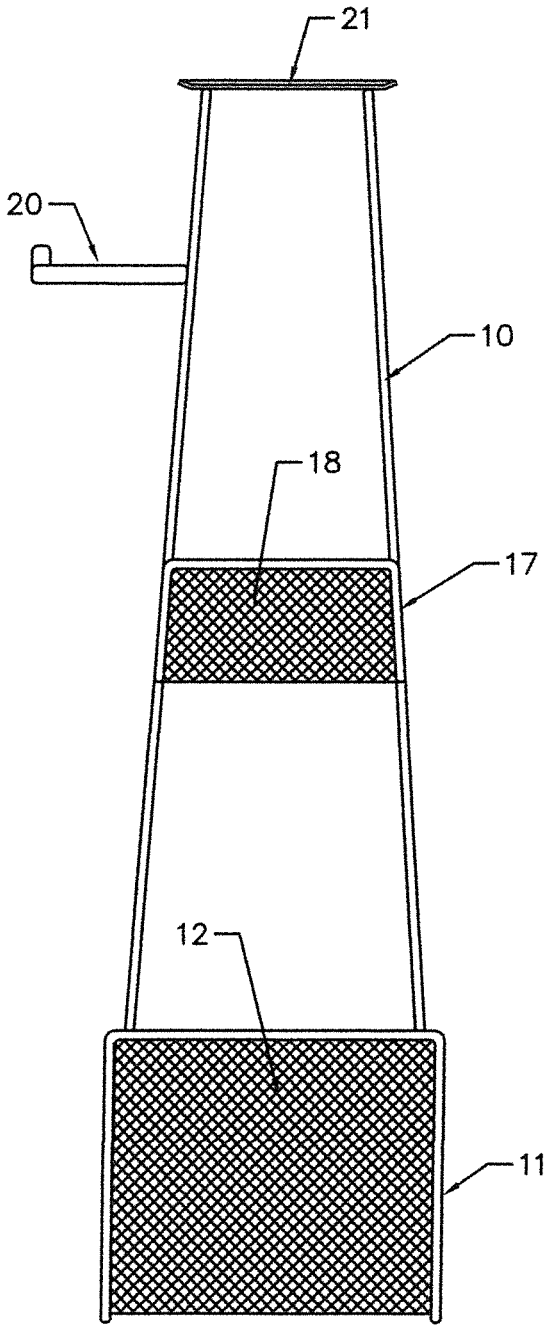
FIG. 4 Is a side view of the Multi-Purpose Bathroom Valet

Referring now to FIGS. 2 and 4, therein shows a perspective side view of the present invention, comprising of a vertical upright standing frame 10, with a u-shaped openings 11, as the base, which is used to support the entire unit. The u-shaped openings 11, is lined with wire mesh 12.

Referring now to FIG. 2, a smaller u-shaped basket 14, that is lined with wire mesh 15, on all five sides, as shown in FIG. 1. Referring now to FIG. 7, there is shown a pictorial view of a divider 16, inside the u-shaped basket 14. The u-shaped basket 14, is attached in the middle of the vertical upright standing frame 10.

Referring now to FIGS. 2 and 4, the main toilet paper holder 20, which is attached near the top of the vertical upright standing frame 10.

Referring now to FIGS. 2 and 4, the beverage holder 21, is attached at the top of the vertical upright standing frame 10.

Referring now to FIG. 4, a u-shaped opening 17, that is lined with wire mesh 18, which is attached to the middle of the vertical upright standing frame 10.

Figure 5:
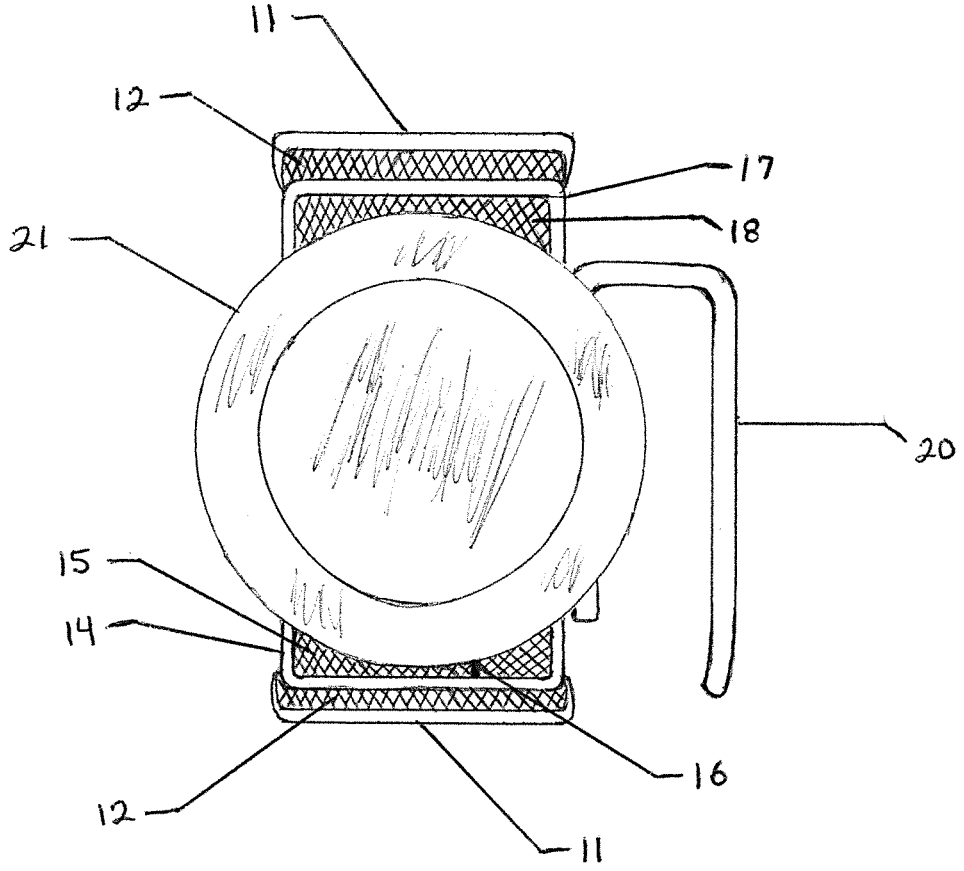
FIG. 5 is a top view of the Multi-Purpose Bathroom Valet

Referring now to FIG. 5, there is shown a perspective top view of the present invention, comprising of the beverage holder 21, the main toilet paper holder 20, the u-shaped openings 11 and 17, and the u-shaped basket 14. The u-shaped openings 11, are lined with wire mesh 12, as shown in FIG. 7. The u-shaped opening 17, is lined with wire mesh 18, as shown in FIG. 7. The u-shaped basket 14, is lined with wire mesh 15. Inside of the u-shaped basket 14, is a divider 16, as shown in FIG. 7.

Figure 6:
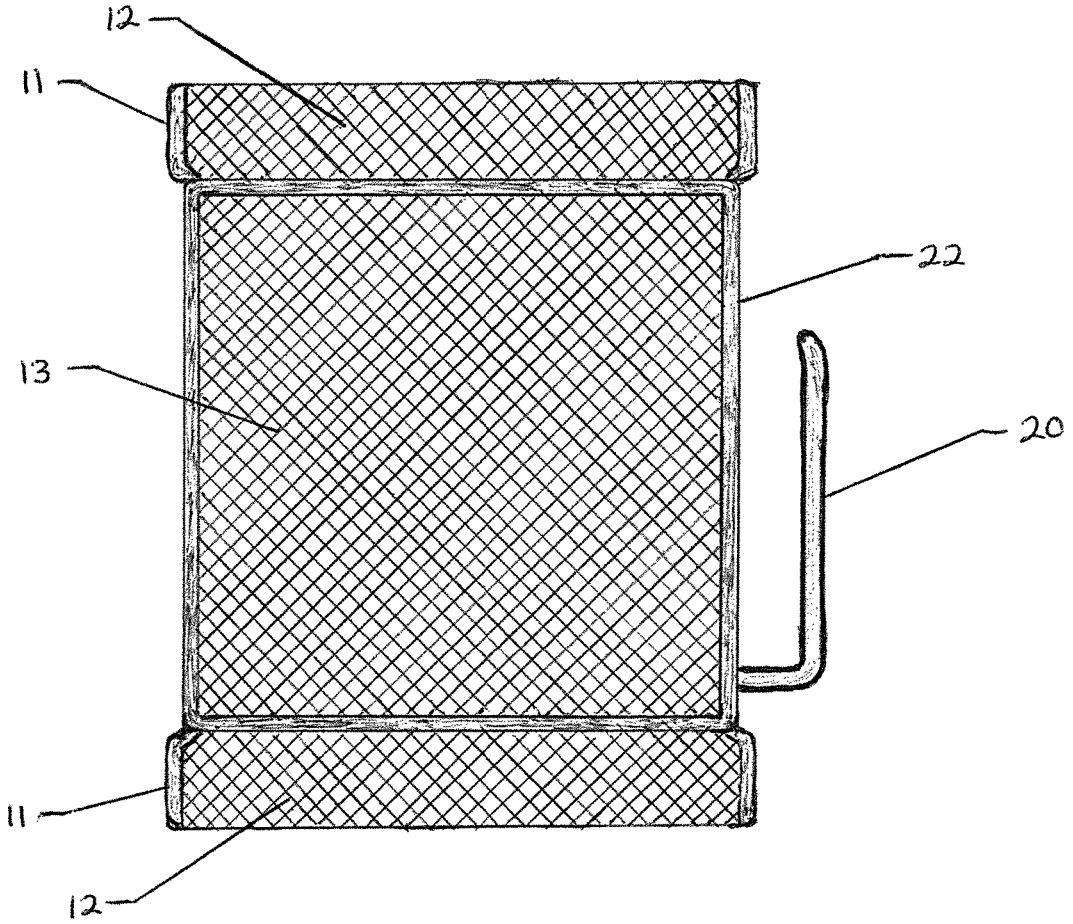
FIG. 6 is a bottom view of the Multi-Purpose Bathroom Valet

Referring now to FIG. 6, there is shown a perspective bottom view of the present invention, comprising of the main toilet paper holder 20, the u-shaped openings 11, lined with wire mesh 12. Between the two u-shaped openings 11, is a wire mesh shelf 13, attached to a metal support frame 22. The metal support frame 22, is attached to the bottom of the vertical upright standing frame 10, as shown in FIG. 1.

Those that are skilled in the art will appreciate that the present invention described above, is non-restricted to the preferred embodiments. For example, the u-shaped openings 11, 14, 17, and the beverage holder 21, can be used as desired for supporting and storing a wide variety of items in addition to what was mentioned above.

Variations may be made therein without departing from the scope of the present invention as defined in the appended following claims.

What is claimed is:

1. A multi-purpose bathroom valet floor rack comprising:

a vertical upright standing frame having a lower, a middle and a top area; wherein the vertical upright standing frame has a left side, a right side, a front side and a back side;

a first and a second u-shaped opening comprised of wire mesh that is attached to a metal support frame; the first and second u-shaped opening are attached to the bottom of the upright standing frame; wherein the first u-shaped opening is attached on the left side; and the second u-shaped opening is attached to the right side;

a lower shelf comprised of wire mesh attached on top of a square metal support frame, wherein the lower shelf is attached between the first and second u-shaped openings;

a u-shaped basket comprised of four sides, a top and a bottom; wherein the four sides and the bottom are enclosed with a wire mesh and wherein the top of the u-shaped basket is open with a divider therein, and wherein the u-shaped basket is attached on the left side of the middle area of said vertical upright standing frame;

a third u-shaped opening comprised of two sides and a bottom; wherein the two sides and the bottom are wire mesh and attached on the right side of the middle area of said vertical upright standing frame;

a middle shelf comprised of wire mesh attached on top of a square metal support frame, wherein the middle shelf is attached in the middle area of said vertical upright standing frame, between said u-shaped basket, and said third u-shaped opening;

a u-shaped bar comprised of a metal rod having a bend on the end to hold a roll of toilet paper on the u-shaped bar, wherein the u-shaped bar is attached between the middle area and the top area of the front side of said vertical upright standing frame;

a round concaved plate beverage holder is comprised of metal and is attached at the very top of the said vertical upright standing frame.

* * * * *